US009139323B2

(12) United States Patent
Secchi et al.

(10) Patent No.: US 9,139,323 B2
(45) Date of Patent: Sep. 22, 2015

(54) MARKLESS REGISTRATION SYSTEM FOR LABELS IN LABELLING MACHINES

(75) Inventors: Antonio Secchi, Parma (IT); Luca De Vincenzi, Parma (IT)

(73) Assignee: Sidel S.P.A., Parma (IT)

( * ) Notice: Subject to any disclaimer, the term of this patent is extended or adjusted under 35 U.S.C. 154(b) by 907 days.

(21) Appl. No.: 13/387,737

(22) PCT Filed: Jul. 29, 2009

(86) PCT No.: PCT/IB2009/053299

§ 371 (c)(1),
(2), (4) Date: Mar. 30, 2012

(87) PCT Pub. No.: WO2011/012927

PCT Pub. Date: Feb. 3, 2011

(65) Prior Publication Data

US 2012/0191251 A1 Jul. 26, 2012

(51) Int. Cl.

| | |
|---|---|
| ***B65C 9/40*** | (2006.01) |
| ***B65C 9/44*** | (2006.01) |
| *B65C 9/42* | (2006.01) |

(52) U.S. Cl.

CPC .... *B65C 9/44* (2013.01); *B65C 9/42* (2013.01)

(58) Field of Classification Search

CPC ..... B65C 9/42; B65C 9/44; G06T 7/0024; G06T 7/0038

USPC ..... 156/64; 700/57, 58, 59, 124, 125

See application file for complete search history.

(56) References Cited

U.S. PATENT DOCUMENTS

| | | | | |
|---|---|---|---|---|
| 6,358,353 | B1 | 3/2002 | Maliner | |
| 2005/0190368 | A1 * | 9/2005 | Ehrhardt et al. | 356/431 |
| 2008/0259111 | A1 * | 10/2008 | McCready et al. | 347/16 |

FOREIGN PATENT DOCUMENTS

| | | |
|---|---|---|
| EP | 0309751 | 4/1989 |
| WO | 2005075330 | 8/2005 |
| WO | 2006061775 | 6/2006 |

* cited by examiner

*Primary Examiner* — George Koch

(74) *Attorney, Agent, or Firm* — Tarter Krinsky & Drogin LLP

(57) ABSTRACT

Registration systems for labels in labelling machines, in order to provide the correct positioning of a label on an object, namely on a container are provided. In particular, the registration system of the invention is applicable on a labelling machine of the type that uses a label reel from which single labels are cut and are applied on a container.

14 Claims, 4 Drawing Sheets

MARKLESS REGISTRATION SYSTEM FOR LABELS IN LABELLING MACHINES

CROSS-REFERENCE TO RELATED APPLICATIONS

This application is a National Phase Application of PCT International Application No. PCT/IB2009/053299, International Filing Date, 29 Jul. 2009, which is hereby incorporated by reference in its entirety.

FIELD OF THE INVENTION

The present invention relates to a registration system for labels in labelling machines, in order to provide the correct positioning of a label on an object, namely on a container.

In particular, the registration system of the invention is applicable on a labelling machine of the type that uses a label reel from which the single labels are cut and are applied on a container.

In these machines, generally known as roll fed labelling machines, the containers are carried by a carrousel and come into contact with a labelling unit. The labelling unit comprises a motorized path wherein at least one feeding roll moves the label strip from a label reel to the carrousel, a cutter, for cutting at the appropriate length the label from the label strip which is moved by the feeding roll, and a so called "vacuum drum" that receives the cut labels and finally transfers the glued labels to the containers in the carrousel.

A perfect synchronization of these operations can not be achieved by means of the initial setting of the machine. In particular, the problem lies on the difficulty to precisely cut labels from a label film by simply synchronising the feeding roll and the vacuum drum movements. First of all, the label strip may be printed in a quite irregular manner, resulting in a series of labels of slightly different length. In general, moreover, the label strip—which is made of a thin elastic plastic material—may be subject to lengthening or shortening as a consequence of the pulling forces exerted by the feeding roll and by the vacuum drum. This may also change with the ambient conditions. Finally, as these machines normally operate with two label reels—one in use and the other as a reservoir—when the first one is empty, the machine provides for the junction of the end of one reel with the head of the reservoir reel. This junction can be inaccurate, because for example the two reels can be overlapped in positions different from the extremities of the labels, such as in the mid portion of the label.

All the reasons set forth above may cause an offset of the label passing through the cutting unit and therefore the obtainment of labels that are inaccurately cut. This cutting error can thus perpetuate for all the remaining labels, with the need to replace the wrong labels on a very high number of containers. This is clearly unacceptable.

To overcome the problem outlined above, it is known to provide the label strip with a plurality of visual marks, such as a black rectangular sign, that are positioned in a portion of the strip between one label and the subsequent one and that therefore identify the end of a label and the beginning of the next label. An optical sensor is positioned along the path of the label strip, upward with respect to the cutter, so that it reads the visual mark, sends a control signal to the control unit of the machine which accelerates or decelerates the feeding roll to adjust the feeding of the label strip to the cutter. In this way, generally, a quite correct operation of the labelling unit is obtained.

However, this system too has some drawbacks. First of all, the printed matter of the label may have some high contrast regions that are read by the optical sensor as the visual mark, so that an erroneous control signal is sent to the system and the cutting adjustment is completely wrong. In this case too a very high number of labels must be eliminated.

Moreover, the portion of the cut label that contains the visual mark must be overlapped by the opposed end of the label, so that the mark is not visible on the container. This is necessary to improve the aesthetical appearance of the labelled container. Therefore, the label must be longer than what would be required, causing a great consumption of material in consideration of the millions of bottles that are labelled a year in a normal bottling plant.

In a labelling machine, besides the above mentioned cutting problems, a number of other operations may be performed wherein the correct registration of the labels can be pivotal.

One example is the above described junction of two reels of labels, the so called splicing operation, that verifies when the end of a reel is spliced to the head of a new label reel. It would be desirable to assure that a correct splicing occurs.

Another example is the printing operation of data, such as the expiry date of the product, on the label. This is typically made along the path of the labelling machine.

In some cases, it is necessary to trigger a check system for the label that typically consists of a vision device. In this case too the correct registration of the labels is important.

It is therefore an object of the present invention to provide a system for the registration of labels unwinding from a reel, with respect to an operation to be performed thereon, in order to overcome the above problems.

This object is achieved by a registration system for the label alignment and a labelling machine comprising the said registration system, as defined in the appended claims whose definitions are integral part of the present description.

BRIEF DESCRIPTION OF THE FIGURES

Further features and advantages of the present invention will be better understood from the description of preferred embodiments, which are given below by way of a non-limiting illustration, with reference to the following figures.

DETAILED DESCRIPTION

In the exemplary embodiment described herein below, reference is made to the registration of the labels in view of the subsequent cutting operation. However, it should be understood that the registration system described below can be applied to any other operation of a labelling machine wherein the correct registration of the labels is desirable, such as splicing, printing and visual checking operations.

The labelling machines or labelling units wherein the present invention can be applicable are the ones wherein the labels are associated to a film, such as the labels printed on the film, whether they are cut and glued for application to the container or they are cut and wound to form a sleeve, or the self adhesive labels that are detached from a support tape before application to a container.

Figure 1:
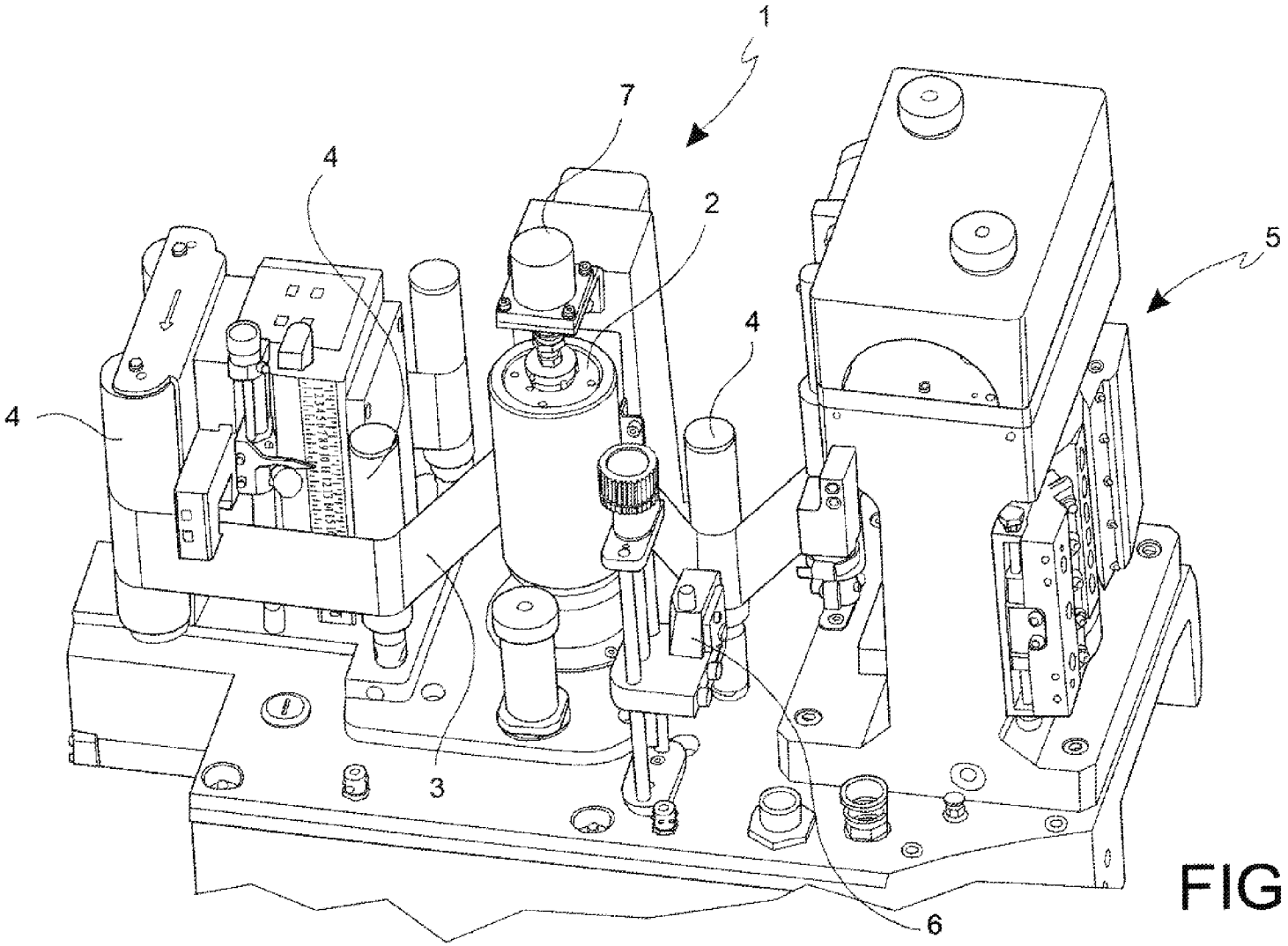
FIG. 1 is a perspective view of a particular of a labelling unit comprising the registration system of the invention.

As shown in FIG. 1, the labelling unit of the invention, indicated with the numeral 1, is a conventional labelling unit that comprises a driven feeding roll 2 that causes the label film 3 coming from a reel (not shown) to move along a path which is defined by a plurality of idle rollers 4. Downstream with respect to the feeding roll 2, it is positioned a cutting unit 5 that provides to divide the label film into single labels that will be drawn by a vacuum drum (not shown) and will then be attached to the containers running on the carrousel (also not shown).

According to the invention, an optical sensing means 6, such as an optical sensor, is located in a suitable position between the feeding roll 2 and the cutting unit 5 in order to read the label surface passing therebetween. For example, the optical sensing means 6 may be located in front of an idle roller 4.

Encoding means 7, such as an incremental encoder, are associated to the feeding roll 2 or to an idle roller 4 or directly to the motor means that drives the feeding roll 2, in order to provide to the system an information of the position of the label film 3 transported thereon. If the encoding means 7 are associated to an idle roller 4, it is essential that no sliding of the film occurs thereon. This can be obtained by coupling the said idle roller 4 to a second idle roller or other pressing means that presses the label film against the idle roller 4 carrying the encoding means 7.

Both the optical sensing means 6 and the encoding means 7 are connected, typically by suitable wiring or by a wireless system, to a computing and control system, that is also operatively connected to the motor means that drives the feeding roll 2, in order to control its rotational speed—and thus the speed of advancement of the label film 3—as a function of the information received by the optical sensing means 6 and computed by the said computing and control system.

The computing and control system of the invention can comprise a computing and control unit integrated in the computer that controls the functioning of the labelling machine. Alternatively, a computing and control unit is integrated in the optical sensing means 6 and dialogs with the computing and control unit of the computer of the labelling machine in order to perform the entire operation. In this case, the computing and control unit associated to the sensing means 6 comprises preferably an FPGA device. This embodiment is preferred, as it allows the present inventive system to be upgraded in a conventional labelling unit, without substantially modify the layout and the control system of the machine.

The registration system of the invention thus comprises the said optical sensing means 6, encoding means 7 and a computing and control system, and provides for a first stage of setting, in order to identify in the label image a reference region, and a second stage of processing comprising reading the position of a processing region of the labels in the label film 3 corresponding to said reference region and controlling an operation of the labelling unit as a function of the position read for the said processing region.

In more details, the inventive system provides for the following steps:

Reading one or more test labels in the label film 3, preferably the heading one or more labels of the said film 3;

Selecting part of or the whole region of the printed matter of said one or more test label as a reference region that functions as a virtual mark of the label, wherein the said selection is made on the basis of the maximization of the signal-to-noise ratio or of a contrast measure;

Reading a subsequent processing label of the label film 3 and identifying a processing region in said label under examination by comparing it with the reference region previously selected in the one or more test labels;

Computing the length of the processing label under examination as the distance between corresponding points of the said processing region and of the reference region of the one or more test labels;

Reading each of the subsequent processing labels in an iterative manner, identifying a processing region in said label under examination by comparing it with the reference region previously selected in the one or more test labels and computing the length of the processing label under examination as the distance between the said processing region and the processing region of the immediately preceding processing label;

Controlling an operation of the labelling machine as a function of the label length computed in the previous step.

The operation of the labelling machine that is controlled by the inventive system is preferably selected from the cutting of a label from a label film, the splicing of two label films, the printing of matter on the label or on the label film and the visual checking of labels or of a label film.

The first stage of setting must be performed only once for each label type, namely at the start of the feeding of the label film 3 and it is typically completed after 3 to 5 labels are passed through the optical sensing means 6.

The second stage of processing coincides with the operative conditions of the labelling unit and lasts as long as the labelling of the containers is protracted.

In one embodiment, the first stage of setting comprises the following operative steps:

1A) Feeding a label film 3 causing it to pass through the said optical sensing means 6 and inputting a first signal of label start and a second signal of label end to the computing and control system, the said first and second signals being associated with a first and second spatial coordinate values, respectively, the interval between said first and second spatial coordinate values defining the test label length;

2A) Reading the printed matter associated to a test label on the label film 3 by passing the said test label along a reading path for the optical sensing means 6 and acquiring a set of signals associated to said test label, to each signal being associated a given signal-to-noise ratio or a given contrast measure and a spatial coordinate value, so that to create a set of spatial coordinate values;

3A) Repeating step 2A) on at least one subsequent test label of the label film 3;

4A) Comparing the signals acquired according to steps 1A) to 3A) and selecting a reference region of the acquired set of signals, the said reference region being the region wherein the signal-to-noise ratio (SNR) or the contrast measure is maximised, a subset of spatial coordinate values being associated to said reference region, the said subset comprising a first and second spatial coordinate values that identify, with respect to the said reading path, the start point and the end point, respectively, of said reference region of the test label;

5A) Computing an offset reference value between the said start point or the said end point of the reference region of the test label and the label start point or alternatively between the said start point or the said end point of the reference region of the test label and the label end point, the said offset reference value being associated with an interval of spatial coordinate values;

6A) Optionally, a) repeating steps 2A), 4A) and 5A) on at least one subsequent test label in the label film 3 and comparing the subset of spatial coordinate values associated with the newly selected reference region and the interval of spatial coordinate values of the newly computed offset reference value with the values obtained in steps 4A) and 5A) to compute a deviation therefrom and b) if the said deviation is above a preset deviation value, repeating steps 1A) to 6A) on further labels until the deviation is below the said preset deviation value.

For the invention purposes, the said spatial coordinate value may be a number N of count encoder, if an incremental encoder is used as an encoding means 7, or any other coordinate value apt to identify the position of a point of the label in the x-space or in the x,y-space. In the case spatial coordinate values in the x,y-space should be used, these values may be given in two different reference systems, such as the number of count encoder for x-axis coordinate and a digital image value for the y-axis coordinate, such as for example the number of pixels from a reference point or the distance in millimeters as calculated by the pixel dimension in the particular reference system.

The signal in the said "set of signals associated to said test label" can be an analogical or a digital image, a contrast measure or another characteristic feature of the label or of the label film, such as the reflectivity thereof, the width of the film or other features related to the material. If the signal is a non digital signal, a transducer will provide to turn it to a digital signal for further processing.

The signal-to-noise ratio, also known as SNR, is given by the ratio between the mean pixel value and the standard deviation of the pixel values. Alternatively, for the purposes of the present invention it may also be used a contrast measure, such as the contrast-to-noise ratio, given by the ratio between the difference of signal intensities of adjacent regions in the image and the standard deviations of the pixel values.

The reference region of the label which is selected according to step 4A) above may be a small region of the label or, in some instances, it may also coincide with the whole printed matter region, if it is not possible to select a clear-cut reference region. This depends on the contrast or the SNR in the image of the label printed matter which varies from case to case. It should be understood that, if two or more items in the test label are selected as having a maximised SNR or contrast measure of the same degree, the whole range of spatial coordinate values containing all these items is taken as a reference region. This allows to minimize the misreading errors in the processing stage.

It should also be understood that the SNR or the contrast measure should be above a pre-determined value in order for the system to read a reference region without inaccuracies. As a very extreme occurrence, if it is not possible to determine a single sub-region of the label wherein the SNR or the contrast measure are maximised, the whole printed matter area will be selected as a reference region.

In summary, the stage of setting allows the inventive system to create its own virtual indentation of the label, without the need to print on the label a reference mark as in the conventional system. In addition, there is no risk that the optical sensing means 6 misread a different contrasted region of the label printed matter instead of the reference mark, as this preliminary stage of setting allows to select the very one reference region wherein the SNR or the contrast measure are maximised or, if more than one highly contrasted regions are present, a broader region that includes them.

The second stage of processing, that corresponds to the normal operation of the labelling unit, is performed with continuity after the said stage of setting and comprises the following steps:

1B) Reading the printed matter associated to a processing label on the label film 3 by passing the said label along a reading path for the optical sensing means 6 and acquiring a set of signals of a label region having an interval of spatial coordinate values that is correlated to the spatial coordinate values of the said reference region, selected according to the stage of setting;

2B) Identifying a processing region in the acquired set of signals of said label region of step 1B) as the region having a maximised SNR or a maximised contrast measure and associating a subset of spatial coordinate values to the said processing region, the said subset comprising a first and a second spatial coordinate values that identify, with respect to the said reading path, the start point and the end point, respectively, of the said processing region;

3B) Computing the distance between the start point or the end point of the processing region of the label under examination and the corresponding start point or end point of the reference region identified according to step 4A), the said distance being indicative of the length of the processing label under examination;

4B) Adding to the start point or to the end point of the said processing region the said offset reference value, computed according to step 5A), the said offset reference value being scaled as a function of the percent variation of the processing label length with respect to the test label length computed at step 1A) in order to determine the start point or the end point of the processing label under examination;

5B) Repeating iteratively steps 3B) and 4B) on each labels or on a plurality of selected sample labels in the label film 3, wherein at step 3B) it is computed the distance between the start point or the end point of the processing region of the label under examination and the corresponding start point or end point of the processing region of the immediately preceding processing label;

6B) Controlling an operation of the labelling machine.

In step 1B), the expression "interval of spatial coordinate values that is correlated to the spatial coordinate values of the said reference region" means that the said interval of spatial coordinate values corresponds to the interval of spatial coordinate values of the reference region or is a multiple thereof by a constant, the said constant being substantially the test label length. This applies in particular if the spatial coordinate values are given by the number of count encoder.

The operation of the labelling machine that is controlled by the inventive system is as defined above. Consequently, the said "controlling an operation" step will depend on the type of the operation and may involve:

varying the rotational speed of the motor means in order to register the incoming processing label in the label film 3 with the cutting unit 5; and/or controlling the splicing means, for example through a solenoid valve or motor, in order to make a junction of two label films together; and/or triggering printing means in order to print a data on the labels or on the label films; and/or triggering a vision system for checking the labels or the label film.

With the term "controlling" a number of steps are meant that normally include:

1) computing the label length on the basis of the information received by the optical sensing means 6;
2) computing an adjustment parameter that takes into account the spatial and time difference between the point of reading and the point wherein the operation is performed;
3) if motor means are controlled, computing the motor speed;
4) sending a control signal to perform the said operation.

All these steps are normally performed, in the conventional systems, by the computer governing the labelling machine operations. The same will apply in the inventive system. In the embodiment wherein the computing and control system is integrated with the said machine computer, the computer software will be modified in order to allow it to perform the inventive stages of setting and processing described above.

However, in the embodiment wherein a computing and control unit is associated to the optical sensing means 6, only the step of controlling the said operation is performed as usual by the labelling machine computer, while the other steps will be performed by the said independent computing and control unit. The advantage of this embodiment lies in the fact that no modification of the software governing the labelling machine is required. Thus, a conventional labelling unit can be upgraded by simply adding the inventive system, comprising the said optical sensing means 6 and the said encoding means 7, to the machine layout. The computing and control unit of the optical sensing means 6 will send the required signals to the labelling machine computer, according to the above described steps.

Figure 2A:
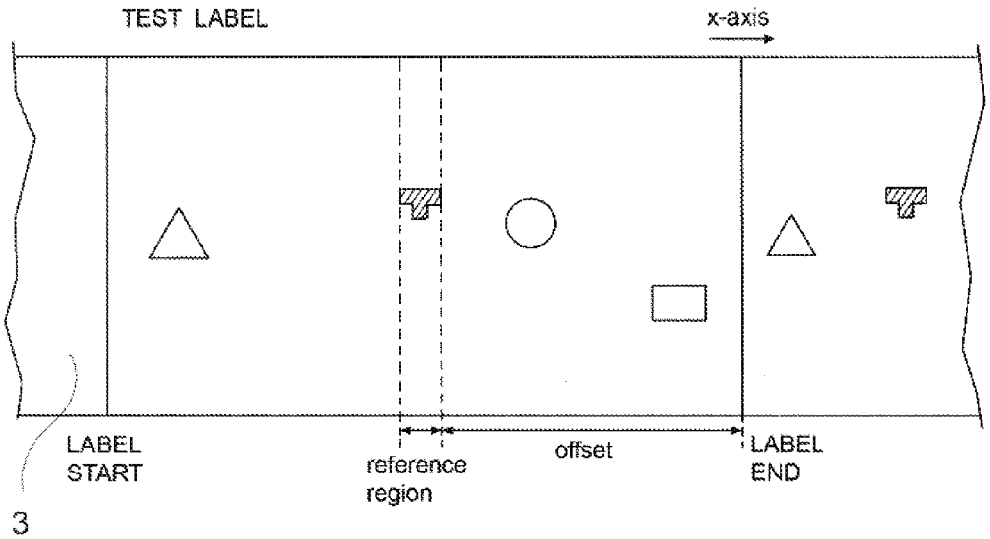
FIGS. 2*a* and 2*b* show a schematic view of a possible situation occurring during label processing in the inventive system.
Figure 2B:
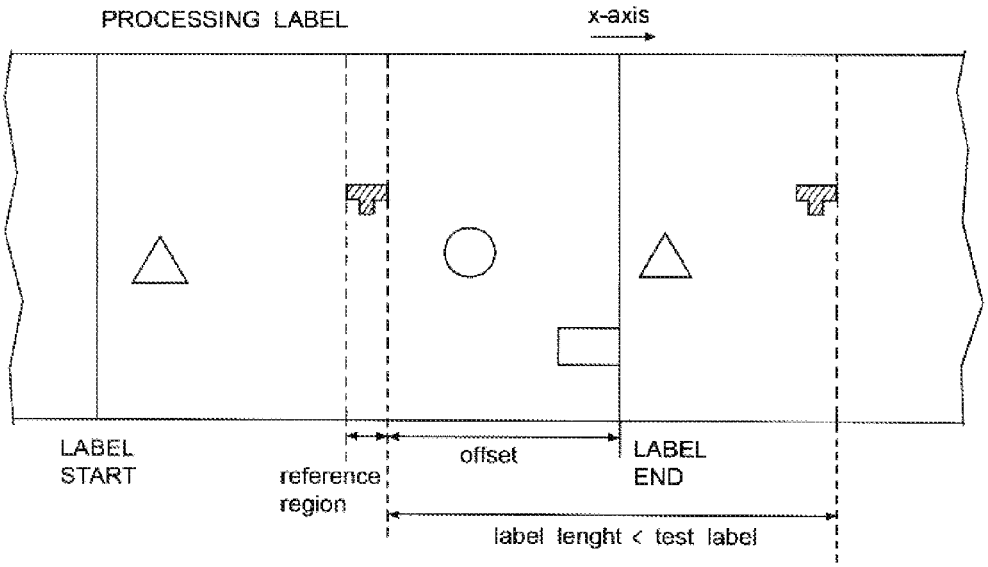
Figure 3A:
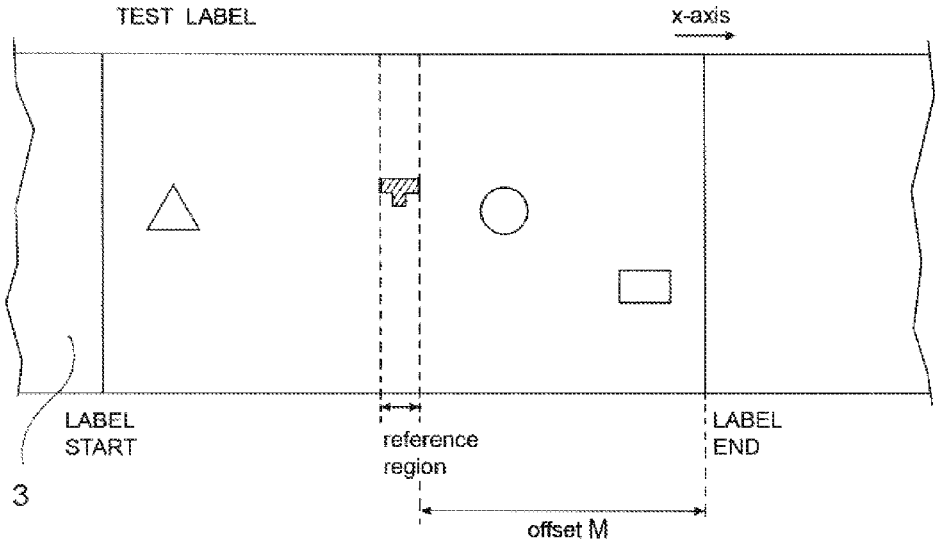
FIGS. 3*a* and 3*b* show a schematic view of a different possible situation occurring during label processing in the inventive system, wherein the wrong alignment in FIG. 3*b* is emphasised for sake of clarity.
Figure 3B:
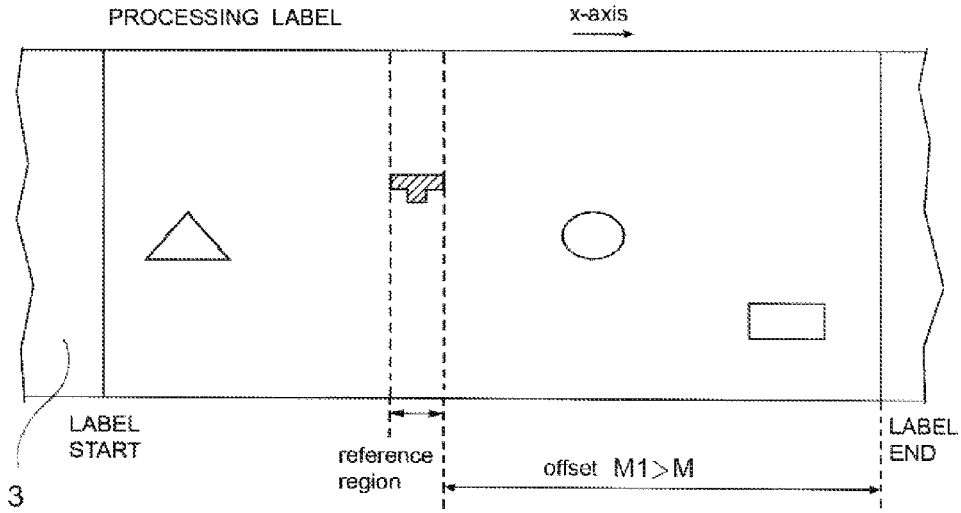

Two cases of variation of the label length may normally occur during processing: i) an inaccuracy in the splicing of two reels of labels together, causing at the junction a label of an erroneous length (FIGS. 2*a* and 2*b*), or ii) a deformation of the label film 3 under stretching (FIGS. 3*a* and 3*b*).

In both cases, the inventive system allows to correct the error or the deformation of the label by computing a new label length and the spatial coordinate values corresponding to the start point or the end point of the label.

The step 3B) of identifying the said processing region is based on the comparison between the processing region with the reference region selected in the test label. This comparison can be performed according to conventional procedures in the art, such as comparison of the pixel intensities and/or quantization to 1 bit by means of digital filters or similar procedures.

The expression "the said offset reference value being scaled as a function of the percent variation of the processing label length with respect to the test label length computed at step 1A)" means that the offset value for the processing label is adjusted, i.e. it is increased or decreased, of a percent amount corresponding to the percent variation (lengthening or shortening) of the processing label under examination with respect to the length of the test label.

The label region whose set of signals is acquired must contain the reference region selected according to the stage of setting and may coincide with such a reference region or preferably being larger in order to allow the system to acquire the set of signals of the reference region as a part of said label region acquired set of signals. In some instances, the label region acquired set of signals will coincide with the whole label.

In one embodiment, the label region whose set of signals is acquired according to step 1B) will be preferably the whole label. In this case, the stage of processing comprises the following steps:

1E) Reading the printed matter associated to a processing label on the label film 3 by passing the said label along a reading path for the optical sensing means 6 and acquiring a set of signals for the whole label;
2E) Selecting a region of the whole label having an interval of spatial coordinate values that is correlated to the spatial coordinate values of the said reference region, selected according to the stage of setting;
3E) Identifying a processing region in the acquired set of signals of said label region of step 2E) as the region having a maximised SNR or a maximised contrast measure and associating a subset of spatial coordinate values to the said processing region, the said subset comprising a first and a second spatial coordinate values that identify, with respect to the said reading path, the start point and the end point, respectively, of the said processing region;
4E) Computing the distance between the start point or the end point of the processing region of step 3E) and the corresponding start point or end point of the reference region identified according to step 4A), the said distance being indicative of the length of the processing label under examination;
5E) Adding to the start point or to the end point of the said processing region the said offset reference value, computed according to step 5A), the said offset reference value being scaled as a function of the percent variation of the processing label length with respect to the test label length computed at step 1A) in order to determine the start point or the end point of the processing label under examination;
6E) Repeating iteratively steps 3E) to 5E) on each labels or on a plurality of selected sample labels in the label film 3, wherein at step 4E) it is computed the distance between the start point or the end point of the processing region of the label under examination and the corresponding start point or end point of the processing region of the immediately preceding processing label;
7E) Controlling an operation of the labelling machine;

wherein, if at step 3E) the said processing region is not identifiable, the said steps 2E) and 3E) are iteratively repeated on a larger label region until the said processing region is identified.

In step 1E), the sampling frequency of the images can be increased in the label region whose interval of spatial coordinate values is correlated with the spatial coordinate values of the said reference region. This oversampling allows to maximise the image resolution in the area of higher demand.

The optical sensing means 6 has a reading window whose width and height, expressed as the number of pixels, must be commensurate with the dimension of the reference region. A too large reading window causes the system to acquire an image of big dimension that make the image processing lengthy. However, if the reading window is too small, most of the relevant information can be missed. Preferably, the dimensions of the reading window of the optical sensing means 6 is comprised between 1×1 and 1×256 pixels.

In some instances, the label can be shifted along the y-axis, as a consequence of a possible vertical shift of the label film 3 on the reel or during unwinding therefrom. In this case it may happen that the inventive system is not able to recognise the processing region, as it has a different spatial coordinate values along the y-axis with respect to the reference region of the test label.

In one embodiment of the invention, to obviate to this problem, the stage of setting outlined above comprises:

1C) Feeding a label film 3 causing it to pass through the said optical sensing means 6 and inputting a first signal of label start and a second signal of label end to the computing and control system, the said first and second signals being associated with a first and second spatial coordinate values, respectively, the interval between said first and second spatial coordinate values defining the test label length;

2C) Reading the printed matter associated to a test label on the label film 3 by passing the said test label along a reading path for the optical sensing means 6 and acquiring a digital image thereof, wherein the reading window of said optical sensing means 6 bestrides the lower or the upper edge of the test label;

3C) Assigning to each point having a given signal-to-noise ratio or a given contrast measure, in the acquired image, a spatial coordinate value, so that to create a set of spatial coordinate values and assigning a spatial coordinate value along the y-axis to the said lower or upper edge of the test label;

4C) Repeating steps 2C) and 3C) on at least one subsequent test label of the label film 3;

5C) Comparing the images acquired according to steps 1C) to 4C) and selecting a reference region of the acquired digital image, the said reference region being preferably the region wherein the signal-to-noise ratio (SNR) or the contrast measure is maximised, a subset of spatial coordinate values being associated to said reference region, the said subset comprising a first and second spatial coordinate values that identify, with respect to the said reading path, the start point and the end point, respectively, of said reference region of the test label;

6C) Computing an offset reference value along the x-axis between the said start point or the said end point of the reference region of the test label and the label start point or alternatively between the said start point or the said end point of the reference region of the test label and the label end point, the said offset reference value being associated with an interval of spatial coordinate values;

7C) Computing the distance along the y-axis between the lower or the upper edge of the label, respectively, and the said selected reference region, wherein the said distance is expressed in terms of a difference of spatial coordinate values along the y-axis;

8C) Optionally, a) repeating steps 2C), 3C), 5C), 6C) and 7C) on at least one subsequent test label in the label film 3 and comparing the subset of spatial coordinate values associated with the newly selected reference region, the interval of spatial coordinate values of the newly computed offset value and the newly calculated distance along the y-axis between the lower or the upper edge of the label, respectively, with the values obtained in steps 5C), 6C) and 7C) to compute a deviation therefrom and b) if the said deviation is above a preset deviation value, repeating steps 1C) to 8C) on further labels until the deviation is below the said preset deviation value.

In this embodiment, the stage of processing will also be modified in order to comprise:

1D) Reading the printed matter associated to a processing label on the label film 3 by passing the said label along a reading path for the optical sensing means 6 and acquiring a digital image of a label region having an interval of spatial coordinate values that is correlated to the spatial coordinate values of the said reference region, selected according to the stage of setting, wherein the reading window of said optical sensing means 6 bestrides the lower or the upper edge of the test label;

2D) Associating to the lower or the upper edge of the processing label under examination a spatial coordinate value along the y-axis and adding to such spatial coordinate value the corresponding distance along the y-axis from the said reference region, as calculated in step 7C), in order to compute a shifted y-axis spatial coordinate value for the said reference region;

3D) Identifying, on the basis of the shifted y-axis spatial coordinate value computed according to step 2D), a processing region in the image region of step 1D) as the region having a maximised SNR or a maximised contrast measure and associating a subset of x-axis spatial coordinate values to the said processing region, the said subset comprising a first and a second spatial coordinate values that identify, with respect to the said reading path, the start point and the end point, respectively, of the said processing region;

4D) Computing the distance between the start point or the end point of the processing region of the label under examination and the corresponding start point or end point of the reference region identified according to step 4A), the said distance being indicative of the length of the processing label under examination;

5D) Adding to the start point or to the end point of the said processing region the said offset reference value, computed according to step 6C), the said offset reference value being scaled as a function of the percent variation of the processing label length with respect to the test label length computed at step 1A) in order to determine the start point or the end point of the processing label under examination 6D) Repeating iteratively steps 3D) to 5D) on each labels or on a plurality of selected sample labels in the label film 3, wherein at step 4D) it is computed the distance between the start point or the end point of the processing region of the label under examination and the corresponding start point or end point of the processing region of the immediately preceding processing label;

7D) Controlling an operation of the labelling machine.

The detection of the label edge can be accomplished by means of known procedures in the art, such as the edge detection methods based on different reflectivity of the label with respect to the background.

Figure 4:
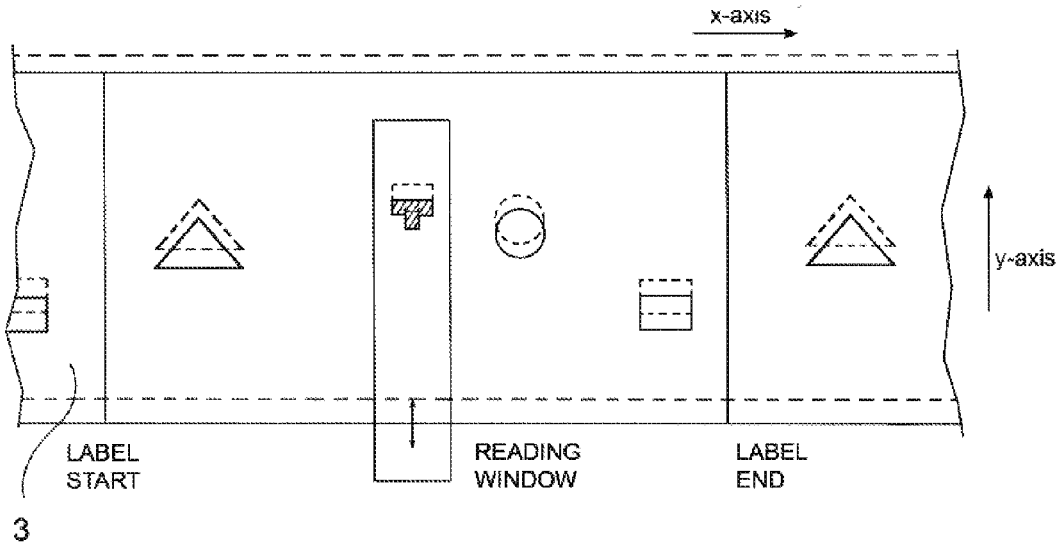
FIG. 4 show a schematic view of a different possible situation occurring during label processing in the inventive system, wherein a disalignment along the y-axis of the label occurred.

FIG. 4 schematically show the above described embodiment in which the reading window of the optical sensing means 6 bestrides the lower edge of the label, in order to sense the shift along the y-axis that may occur in the processing of a label film 3.

The advantages of the inventive system and of the labelling unit comprising it are evident.

As the system tailors on each label type a virtual mark, no risk of misreading can occur during the processing of the labels, as explained before.

Moreover, as the conventional visual mark is avoided, there is no need to overlap the two ends of the label on the container to hide the visual mark, as in the conventional systems. In other words, the label can be shorter than usual. This results in a considerable saving of the material of the label film with substantial cost savings.

Another advantage of the inventive system, particularly if the computing and control unit is integrated in the optical sensing means 6, is that this registration system can be used to upgrade existing labelling units, without the need to replace the whole unit. This is also a substantial cost saving.

It will be appreciated that only particular embodiments of the present invention have been described herein, to which those skilled in the art will be able to make any and all modifications necessary for its adjustment to specific applications, without however departing from the scope of protection of the present invention as defined in the annexed claims.

The invention claimed is:

1. A method for controlling labelling in labelling machines comprising the sequential steps of:

in a first step, determining which part of the printed matter of a test label in a label film has a maximum measure of signal-to-noise ratio or contrast to constitute a reference region;

in a second step, identifying a processing region of a subsequent processing label of the label film;

in a third step, comparing corresponding points of said processing region with said reference region and computing the length of the processing label;

in a fourth step, reading each processing region of each subsequent processing label, comparing it with said reference region, and computing the length of the processing label, and in a fifth step, controlling an operation of the labelling machine as a function of the label length computed in the previous step.

2. The method of claim 1, further comprising:

1E) Reading the printed matter associated with a processing label on the label film by passing said label along a reading path for an optical sensor and acquiring a set of signals for the whole label;

2E) Selecting a region of the whole label having an interval of spatial coordinate values that is correlated to the spatial coordinate values of said reference region, selected according to the stage of setting;

3E) Identifying a processing region in the acquired set of signals of said label region of step 2E) as the region having a maximised SNR or a maximised contrast measure and associating a subset of spatial coordinate values to said processing region, said subset comprising a first and a second spatial coordinate values that identify, with respect to said reading path, the start point and the end point, respectively, of said processing region;

4E) Computing the distance between the start point or the end point of the processing region of step 3E) and the corresponding start point or end point of the reference region identified according to step 4A), said distance being indicative of the length of the processing label under examination;

5E) Adding to the start point or to the end point of said processing region said offset reference value, computed according to step 5A), said offset reference value being scaled as a function of the percent variation of the processing label length with respect to the test label length computed at step 1A) in order to determine the start point or the end point of the processing label under examination;

6E) Repeating iteratively steps 3E) to 5E) on each labels or on a plurality of selected sample labels in the label film, wherein at step 4E) it is computed the distance between the start point or the end point of the processing region of the label under examination and the corresponding start point or end point of the processing region of the immediately preceding processing label;

7E) Controlling an operation of the labelling machine;

wherein, if at step 3E) said processing region is not identifiable, said steps 2E) and 3E) are iteratively repeated on a larger label region until said processing region is identified.

3. The method of claim 2, wherein in step 1E) sampling frequency of the images may be increased in the label region whose interval of spatial coordinate values is correlated with the spatial coordinate values of said reference region.

4. A method for controlling labelling in labelling machines, comprising the steps of:

reading one or more test labels in the label film, or a heading of one or more labels of said label film;

selecting part of or the whole region of the printed matter of said one or more test label as a reference region that functions as a virtual mark of the label, wherein said selection is made on the basis of the maximization of the signal-to-noise ratio or of a contrast measure;

reading a subsequent processing label of the label film and identifying a processing region in said label under examination by comparing it with the reference region previously selected in the one or more test labels;

computing the length of the processing label under examination as the distance between corresponding points of said processing region and of the reference region of the one or more test labels;

reading each of the subsequent processing labels in an iterative manner, identifying a processing region in said label under examination by comparing it with the reference region previously selected in the one or more test labels and computing the length of the processing label under examination as the distance between said processing region and the processing region of the immediately preceding processing label; and controlling an operation of the labelling machine as a function of the label length computed in a previous step.

5. The method of claim 4 further comprising:

1C) Feeding a label film causing it to pass through an optical sensor and inputting a first signal of label start and a second signal of label end to the computing and control system, said first and second signals being associated with a first and second spatial coordinate values, respectively, the interval between said first and second spatial coordinate values defining the test label length;

2C) Reading the printed matter associated to a test label on the label film by passing said test label along a reading path for the optical sensor and acquiring a digital image thereof, wherein the reading window of the optical sensor bestrides the lower or the upper edge of the test label;

3C) Assigning to each point having a given signal-to-noise ratio or a given contrast measure, in the acquired image, a spatial coordinate value, so that to create a set of spatial coordinate values and assigning a spatial coordinate value along the y-axis to said lower or upper edge of the test label;

4C) Repeating steps 2C) and 3C) on at least one subsequent test label of the label film;

5C) Comparing the images acquired according to steps 1C) to 4C) and selecting a reference region of the acquired digital image, said reference region being preferably the region wherein the signal-to-noise ratio (SNR) or the contrast measure is maximised, a subset of spatial coordinate values being associated to said reference region, said subset comprising a first and second spatial coordinate values that identify, with respect to said reading path, the start point and the end point, respectively, of said reference region of the test label;

6C) Computing an offset reference value along the x-axis between said start point or said end point of the reference region of the test label and the label start point or alternatively between said start point or said end point of the reference region of the test label and the label end point, said offset reference value being associated with an interval of spatial coordinate values;

7C) Computing the distance along the y-axis between the lower or the upper edge of the label, respectively, and said selected reference region, wherein said distance is expressed in terms of a difference of spatial coordinate values along the y-axis.

6. The method of claim 5 further comprising:

1D) Reading the printed matter associated to a processing label on the label film by passing said label along a reading path for the optical sensor and acquiring a digital image of a label region having an interval of spatial coordinate values that is correlated to the spatial coordinate values of said reference region, selected according to the stage of setting, wherein the reading window of the optical sensor bestrides the lower or the upper edge of the test label;

2D) Associating to the lower or the upper edge of the processing label under examination a spatial coordinate value along the y-axis and adding to such spatial coordinate value the corresponding distance along the y-axis from said reference region, as calculated in step 7C), in order to compute a shifted y-axis spatial coordinate value for said reference region;

3D) Identifying, on the basis of the shifted y-axis spatial coordinate value computed according to step 2D), a processing region in the image region of step 1D) as the region having a maximised SNR or a maximised contrast measure and associating a subset of x-axis spatial coordinate values to said processing region, said subset comprising a first and a second spatial coordinate values that identify, with respect to said reading path, the start point and the end point, respectively, of said processing region;

4D) Computing the distance between the start point or the end point of the processing region of the label under examination and the corresponding start point or end point of the reference region identified according to step 4A), said distance being indicative of the length of the processing label under examination;

5D) Adding to the start point or to the end point of said processing region said offset reference value, computed according to step 6C), said offset reference value being scaled as a function of the percent variation of the processing label length with respect to the test label length computed at step 1A) in order to determine the start point or the end point of the processing label under examination 6D) Repeating iteratively steps 3D) to 5D) on each labels or on a plurality of selected sample labels in the label film, wherein at step 4D) it is computed the distance between the start point or the end point of the processing region of the label under examination and the corresponding start point or end point of the processing region of the immediately preceding processing label;

7D) Controlling an operation of the labelling machine.

7. The method of claim 6, wherein said step of controlling an operation comprises:

varying the rotational speed of a motor in order to register the incoming processing label in the label film with the cutting unit; and/or controlling splicing to make a junction of two label films together; and/or triggering a printer to print data on the labels or on the label films; and/or triggering a vision system for checking the labels or the label film.

8. A method for controlling labelling in labelling machines comprising the steps of:

1A) Feeding a label film causing it to pass through an optical sensor and inputting a first signal of label start and a second signal of label end to the computing and control system, said first and second signals being associated with a first and second spatial coordinate values, respectively, the interval between said first and second spatial coordinate values defining the test label length;

2A) Reading the printed matter associated to a test label on the label film by passing said test label along a reading path for the optical sensor and acquiring a set of signals associated to said test label, to each signal being associated a given signal-to-noise ratio or a given contrast measure and a spatial coordinate value, so that to create a set of spatial coordinate values;

3A) Repeating step 2A) on at least one subsequent test label of the label film;

4A) Comparing the signals acquired according to steps 1A) to 3A) and selecting a reference region of the acquired set of signals, said reference region being the region wherein the signal-to-noise ratio (SNR) or the contrast measure is maximised, a subset of spatial coordinate values being associated to said reference region, said subset comprising a first and second spatial coordinate values that identify, with respect to said reading path, the start point and the end point, respectively, of said reference region of the test label;

5A) Computing an offset reference value between said start point or said end point of the reference region of the test label and the label start point or alternatively between said start point or said end point of the reference region of the test label and the label end point, said offset reference value being associated with an interval of spatial coordinate values.

9. The method of claim 8 further comprising:

1B) Reading the printed matter associated to a processing label on the label film by passing said label along a reading path for the optical sensor and acquiring a set of signals of a label region having an interval of spatial coordinate values that is correlated to the spatial coordinate values of said reference region, selected according to the stage of setting;

2B) Identifying a processing region in the acquired set of signals of said label region of step 1B) as the region having a maximised SNR or a maximised contrast measure and associating a subset of spatial coordinate values to said processing region, said subset comprising a first and a second spatial coordinate values that identify, with respect to said reading path, the start point and the end point, respectively, of said processing region;

3B) Computing the distance between the start point or the end point of the processing region of the label under examination and the corresponding start point or end point of the reference region identified according to step 4A), said distance being indicative of the length of the processing label under examination;

4B) Adding to the start point or to the end point of said processing region said offset reference value, computed according to step 5A), said offset reference value being scaled as a function of the percent variation of the processing label length with respect to the test label length computed at step 1A) in order to determine the start point or the end point of the processing label under examination;

5B) Repeating iteratively steps 3B) and 4B) on each labels or on a plurality of selected sample labels in the label film, wherein at step 3B) it is computed the distance between the start point or the end point of the processing region of the label under examination and the corresponding start point or end point of the processing region of the immediately preceding processing label; and 6B) Controlling an operation of the labelling machine.

10. The method of claim 9, wherein said spatial coordinate value is a number N of count encoder, if an incremental encoder is used to encode, or any other coordinate value apt to identify the position of a point of the label in the x-space or in the x,y-space.

11. The method of claim 9, wherein said signal of the set of signals is an analogical or a digital image, a contrast measure or another characteristic feature of the label or of the label film, such as the reflectivity thereof, the width of the film or other features related to the material.

12. The method of claim 9, wherein said computing and controlling steps are integrated with a computer governing said labelling machine.

13. The method of claim 9, wherein said computing and controlling steps are performed by a computing and control unit associated with said optical sensor.

14. The method of claim 8, wherein the labelling machine performs one or more of following operations:

1) computing the label length on the basis of the information received by the optical sensor;

2) computing an adjustment parameter that takes into account the spatial and time difference between the point of reading and the point wherein the operation is performed; and 3) sending a control signal to perform said operation.

* * * * *